US012758062B2

(12) United States Patent
Obermark

(10) Patent No.: US 12,758,062 B2
(45) Date of Patent: Oct. 13, 2026

(54) TOILET GAG GIFT DEVICE

(71) Applicant: Brent Obermark, West Paducah, KY (US)

(72) Inventor: Brent Obermark, West Paducah, KY (US)

( * ) Notice: Subject to any disclaimer, the term of this patent is extended or adjusted under 35 U.S.C. 154(b) by 0 days.

(21) Appl. No.: 18/418,497

(22) Filed: Jan. 22, 2024

(65) Prior Publication Data

US 2025/0017428 A1 Jan. 16, 2025

Related U.S. Application Data

(60) Provisional application No. 63/512,761, filed on Jul. 10, 2023.

(51) Int. Cl.
*A47K 17/02* (2006.01)

(52) U.S. Cl.
CPC ..... *A47K 17/02* (2013.01); *A47K 2201/00* (2013.01)

(58) Field of Classification Search
CPC ..... E03D 13/005; E03D 11/00; A47K 17/02
See application file for complete search history.

(56) References Cited

U.S. PATENT DOCUMENTS

| | | | | |
|---|---|---|---|---|
| 3,914,803 | A | 10/1975 | Gregovski | |
| 4,010,497 | A | 3/1977 | Menter | |
| 5,117,512 | A | 6/1992 | Bressler | |
| 5,373,589 | A | 12/1994 | Rego | |
| 5,890,242 | A * | 4/1999 | Minter | A47K 17/00 4/661 |
| 6,119,282 | A | 9/2000 | Serbin | |
| 7,798,907 | B2 * | 9/2010 | Piccionelli | A63F 9/0204 273/350 |
| 9,145,667 | B1 * | 9/2015 | Laurent | E03D 9/00 |
| 9,955,830 | B1 | 5/2018 | Harris | |
| 11,255,081 | B2 * | 2/2022 | Oh | G01N 33/521 |
| 2013/0318698 | A1 * | 12/2013 | Schilpp | A47K 17/02 4/254 |

* cited by examiner

*Primary Examiner* — Janie M Loeppke
(74) *Attorney, Agent, or Firm* — Brennan, Manna & Diamond, LLC

(57) ABSTRACT

A toilet gag gift device is provided. The device is comprised of a receiving area, wherein the device is intended to be placed inside a toilet bowl, and wherein the receiving area is designed to non-literally receive the scrotum of a user as a joke relating to scrotal ptosis. In one embodiment, the receiving area may also be comprised of humorous indicia relating to scrotal ptosis. In another embodiment, the device may be comprised of a motion-activated speaker that may place a phrase, song, word, joke, etc., that relates to scrotal ptosis.

12 Claims, 5 Drawing Sheets

TOILET GAG GIFT DEVICE

CROSS-REFERENCE TO RELATED APPLICATION

The present application claims priority to, and the benefit of, U.S. Provisional Application No. 63/512,761, which was filed on Jul. 10, 2023, and is incorporated herein by reference in its entirety.

FIELD OF THE INVENTION

The present invention relates generally to the field of gag gifts. More specifically, the present invention relates to a toilet gag gift device comprised of a receiving area, wherein the device is intended to be placed inside a toilet bowl and wherein the receiving area is designed to non-literally receive the scrotum of a user as a joke relating to scrotal ptosis. Accordingly, the present disclosure makes specific reference thereto. Nonetheless, it is to be appreciated that aspects of the present invention are also equally applicable to other like applications, devices, and methods of manufacture.

BACKGROUND

The phenomenon of 'sagging' testicles, medically referred to as scrotal ptosis, is a natural part of the aging process in men. This physiological change involves a gradual lowering of the testicles as the scrotal skin loses elasticity and the muscles become less taut. The humor in such jokes often lies in the exaggerated portrayal of this natural occurrence, poking fun at the inevitability of aging and the often comical discomfort that can come with body changes.

This particular brand of humor has carved out a niche within the broader realm of comedy, especially among those who appreciate humor that pushes the boundaries of social norms and propriety. The allure of integrating this kind of humor into gift-giving lies in its ability to evoke laughter and perhaps a shared sense of camaraderie in facing the universal march of time.

Gifting items that encapsulate this joke entails a creative and often exhaustive search for products that strike the right balance between hilarity and taste. Moreover, the challenge in procuring these gifts is not only in their scarcity but also in ensuring they are suitable for the recipient's sense of humor and the context in which they will be presented. A gift that is received in good spirits in one setting may be deemed inappropriate in another, making the act of giving such gifts a delicate art form that necessitates a keen understanding of social dynamics and individual preferences.

Therefore, there exists a long-felt need in the art for a gag gift device. There also exists a long-felt need in the art for a gag gift device that jokes about the condition of scrotal ptosis. Further, there exists a long-felt need in the art for a gag gift device that jokes about the condition of scrotal ptosis wherein the device remains unoffensive to those with no knowledge of the joke.

The subject matter disclosed and claimed herein, in one embodiment thereof, comprises a toilet gag gift device. The device is comprised of a receiving area, wherein the device is intended to be placed inside a toilet bowl, and wherein the receiving area is designed to non-literally receive the scrotum of a user as a joke relating to scrotal ptosis. In one embodiment, the receiving area may also be comprised of humorous indicia relating to scrotal ptosis. In another embodiment, the device may be comprised of a motion-activated speaker that may place a phrase, song, word, joke, etc. that relates to scrotal ptosis.

In this manner, the toilet gag gift device of the present invention accomplishes all the foregoing objectives and provides a gag gift. More specifically, the device provides a gag gift device that jokes about the condition of scrotal ptosis. Further, the appearance of the device ensures it remains unoffensive to those with no knowledge of the joke.

SUMMARY

The following presents a simplified summary to provide a basic understanding of some aspects of the disclosed innovation. This summary is not an extensive overview, and it is not intended to identify key/critical elements or to delineate the scope thereof. Its sole purpose is to present some general concepts in a simplified form as a prelude to the more detailed description that is presented later.

The subject matter disclosed and claimed herein, in one embodiment thereof, comprises a toilet gag gift device. The device is comprised of a basket-like body with at least one receiving area that is intended as a humorous, non-literal receiving area for the scrotum of the user, wherein the device can be placed within a toilet bowl. The area preferably resembles a basket (i.e., woven). The receiving area may be comprised of at least one indicia that may be in the form of a word, a phrase, a joke, a symbol, an image, etc., that may relate humorously to the condition of scrotal ptosis.

The body is supported by at least one leg. In one embodiment, the leg is bendable to allow the position of the device within a toilet bowl to be adjusted. In one embodiment, the leg is comprised of at least one fastener that secures the leg to the toilet bowl.

In one embodiment, the device is comprised of at least one speaker that may be activated by at least one motion sensor. In this manner, when the sensor detects a user is approaching the toilet bowl to urinate the speaker plays a phrase, song, word, joke, etc., that may relate humorously to the condition of scrotal ptosis. The speaker and sensor may be powered via at least one battery.

The present invention is also comprised of a method of using the device. First, a device 100 is provided comprised of a body having a receiving area and at least one leg. Then, the device can be placed within a toilet bowl as a humorous joke intended to play on scrotal ptosis.

The present invention is also comprised of another method of using the device. First, a device is provided comprised of a speaker, a sensor, and a body having a receiving area and at least one leg comprised of at least one fastener. Then, the device can be placed within a toilet bowl as a humorous joke intended to play on scrotal ptosis, wherein the leg is secured to the toilet bowl via the fastener. Next, a user can approach and/or urinate into the toilet bowl such that the sensor detects motion of the user and causes the speaker to activate to play a phrase, song, word, joke, etc., that may relate humorously to the condition of scrotal ptosis.

Accordingly, the toilet gag gift device of the present invention is particularly advantageous as it provides a gag gift. More specifically, the device provides a gag gift device that jokes about the condition of scrotal ptosis. Further, the appearance of the device ensures it remains unoffensive to those with no knowledge of the joke. In this manner, the toilet gag gift provides a solution to finding appropriate gag gifts for scrotal ptosis.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and are intended to include all such aspects and their equivalents. Other advantages and novel features will become apparent from the following detailed description when considered in conjunction with the drawings.

BRIEF DESCRIPTION OF THE DRAWINGS

The description refers to provided drawings in which similar reference characters refer to similar parts throughout the different views, and in which.

DETAILED DESCRIPTION

Figure 1:
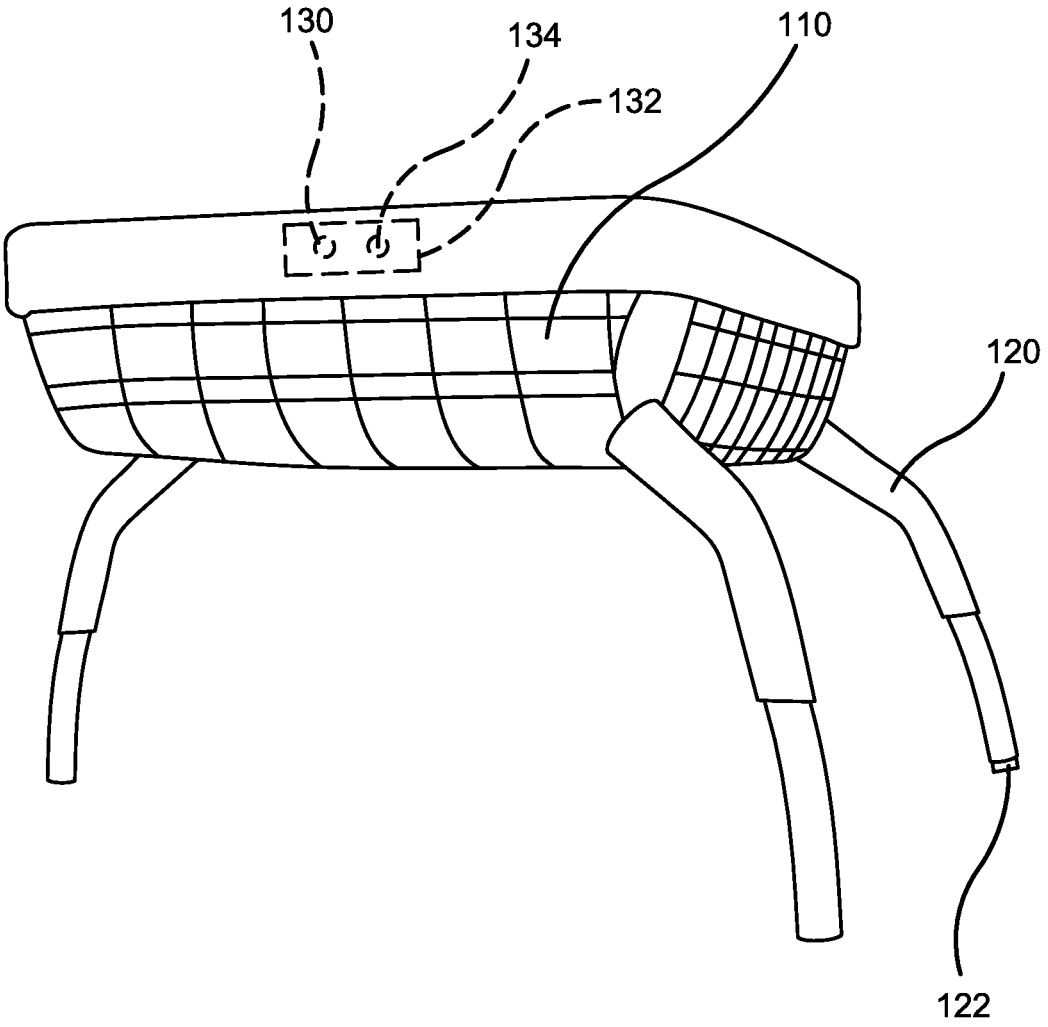
FIG. 1 illustrates a perspective view of one potential embodiment of a toilet gag gift device of the present invention in accordance with the disclosed architecture.

The innovation is now described with reference to the drawings, wherein like reference numerals are used to refer to like elements throughout. In the following description, for purposes of explanation, numerous specific details are set forth to provide a thorough understanding thereof. It may be evident, however, that the innovation can be practiced without these specific details. In other instances, well-known structures and devices are shown in block diagram form to facilitate a description thereof. Various embodiments are discussed hereinafter. It should be noted that the figures are described only to facilitate the description of the embodiments. They are not intended as an exhaustive description of the invention and do not limit the scope of the invention. Additionally, an illustrated embodiment need not have all the aspects or advantages shown. Thus, in other embodiments, any of the features described herein from different embodiments may be combined.

As noted above, there exists a long-felt need in the art for a gag gift device. There also exists a long-felt need in the art for a gag gift device that jokes about the condition of scrotal ptosis. Further, there exists a long-felt need in the art for a gag gift device that jokes about the condition of scrotal ptosis wherein the device remains unoffensive to those with no knowledge of the joke. The present invention, in one exemplary embodiment, is comprised of a toilet gag gift device.

The device is comprised of a basket-like body with at least one receiving area that is intended as a humorous, non-literal receiving area for the scrotum of the user, wherein the device can be placed within a toilet bowl. The area preferably resembles a basket (i.e., woven). The receiving area may be comprised of at least one indicia that may be in the form of a word, a phrase, a joke, a symbol, an image, etc., that may relate humorously to the condition of scrotal ptosis.

The body is supported by at least one leg. In one embodiment, the leg is bendable to allow the position of the device within a toilet bowl to be adjusted. In one embodiment, the leg is comprised of at least one fastener that secures the leg to the toilet bowl.

In one embodiment, the device is comprised of at least one speaker that may be activated by at least one motion sensor. In this manner, when the sensor detects a user is approaching the toilet bowl to urinate the speaker plays a phrase, song, word, joke, etc., that may relate humorously to the condition of scrotal ptosis. The speaker and sensor may be powered via at least one battery.

The present invention is also comprised of a method of using the device. First, a device 100 is provided comprised of a body having a receiving area and at least one leg. Then, the device can be placed within a toilet bowl as a humorous joke intended to play on scrotal ptosis.

The present invention is also comprised of another method of using the device. First, a device is provided comprised of a speaker, a sensor, and a body having a receiving area and at least one leg comprised of at least one fastener. Then, the device can be placed within a toilet bowl as a humorous joke intended to play on scrotal ptosis, wherein the leg is secured to the toilet bowl via the fastener. Next, a user can approach and/or urinate into the toilet bowl such that the sensor detects motion of the user and causes the speaker to activate to play a phrase, song, word, joke, etc., that may relate humorously to the condition of scrotal ptosis.

Accordingly, the toilet gag gift device of the present invention is particularly advantageous as it provides a gag gift. More specifically, the device provides a gag gift device that jokes about the condition of scrotal ptosis. Further, the appearance of the device ensures it remains unoffensive to those with no knowledge of the joke. In this manner, the toilet gag gift provides a solution to finding appropriate gag gifts for scrotal ptosis.

Referring initially to the drawings, FIG. 1 illustrates a perspective view of one potential embodiment of a toilet gag gift device 100 of the present invention in accordance with the disclosed architecture. The device 100 is comprised of a basket-like body 110 with at least one receiving area 112. The receiving area 112 is intended as a humorous, non-literal receiving area for the scrotum of the user, wherein the device 100 can be placed within a toilet bowl 10.

The device 100 is preferably made from a plastic material. The device 100 may be any color, pattern, etc., known in the art. In one embodiment, the device 100 is scented (with any scent known in the art) to provide a pleasant smell within a toilet bowl 10 (similar to a urinal cake).

Figure 2:
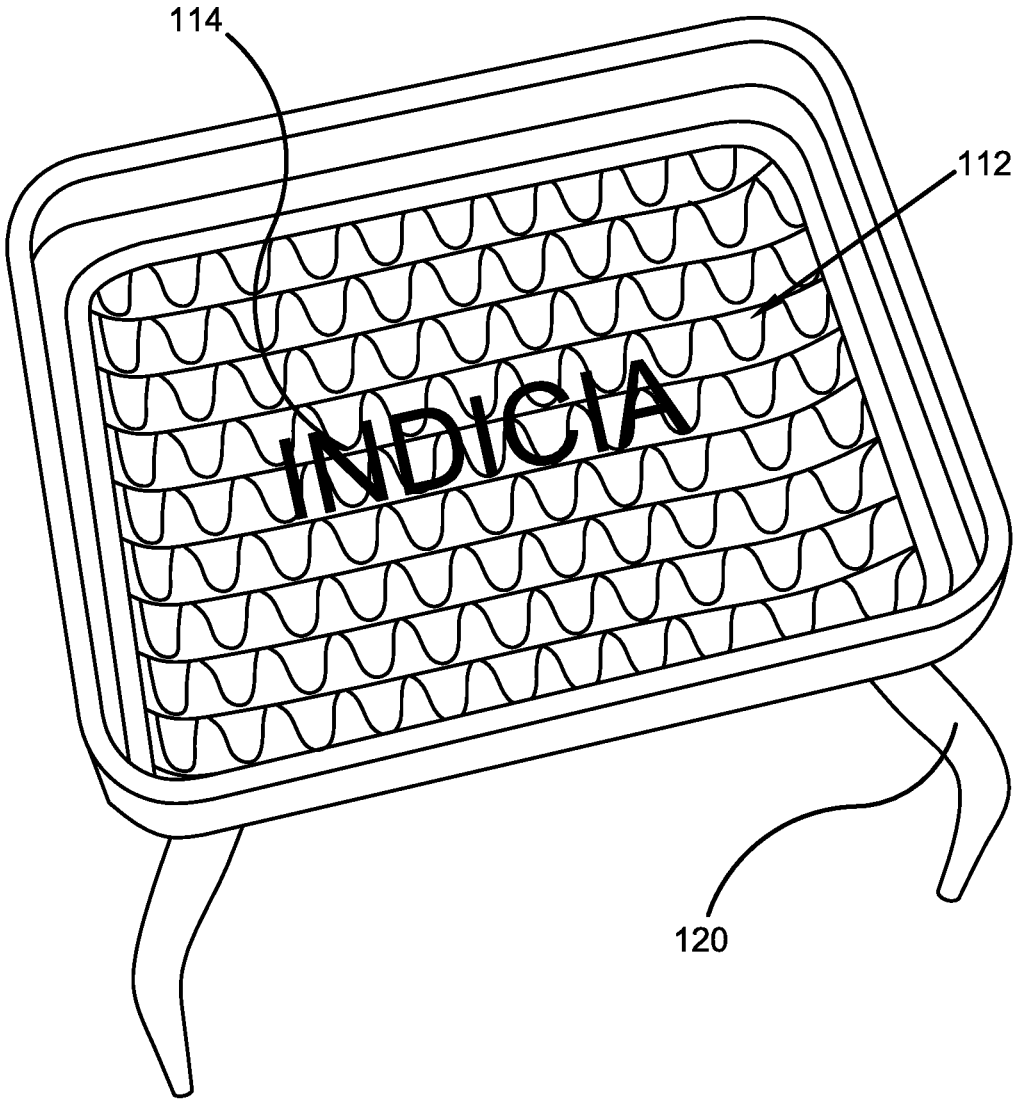
FIG. 2 illustrates a perspective view of one potential embodiment of a toilet gag gift device of the present invention in accordance with the disclosed architecture.

The body 110 is comprised of at least one receiving area 112. The area 112 preferably resembles a basket (i.e., woven). The area 112 may be made from a mesh (i.e., porous) material or a solid material in different embodiments. The receiving area 112 may be comprised of at least one indicia 114, as seen in FIG. 2. The indicia 114 may be in the form of a word, a phrase, a joke, a symbol, an image, etc., that may relate humorously to the condition of scrotal ptosis.

Figure 3:
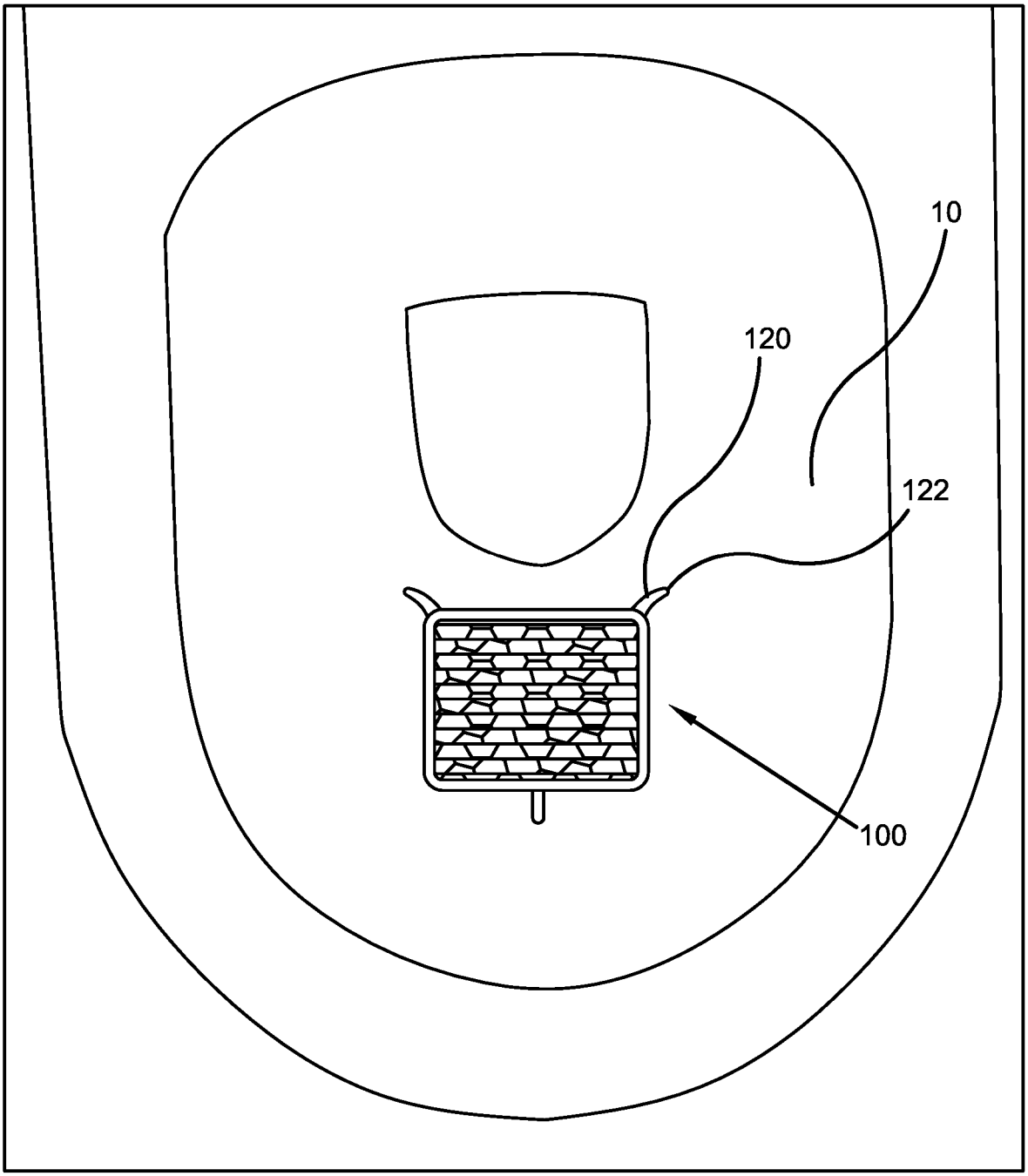
FIG. 3 illustrates a top view of one potential embodiment of a toilet gag gift device of the present invention while placed within a toilet bowl in accordance with the disclosed architecture.

The body 110 is supported by at least one leg 120. In one embodiment, the leg 120 is bendable to allow the position of the device 100 within a toilet bowl 10 (as seen in FIG. 3) to be adjusted. In one embodiment, the leg 120 is comprised of at least one fastener 122 that secures the leg 120 to the toilet bowl 10. Said fastener 122 may include, but is not limited to, a suction cup, an adhesive, a magnet, etc.

In one embodiment, the device 100 is comprised of at least one speaker 130. The speaker 130 may be activated by at least one motion sensor 134. In this manner, when the sensor 134 detects a user is approaching the toilet bowl 10 to urinate the speaker 130 plays a phrase, song, word, joke, etc., that may relate humorously to the condition of scrotal ptosis. The speaker 130 and sensor 134 may be powered via at least one battery 132. The battery 132 may be a removable or non-removable battery in different embodiments that may be rechargeable or disposable.

Figure 4:
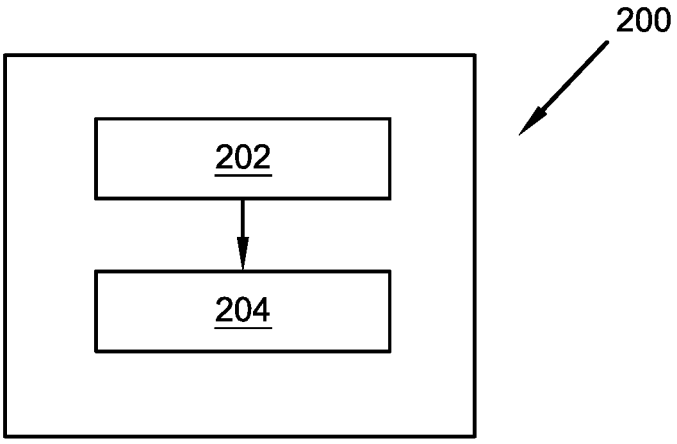
FIG. 4 illustrates a flowchart of a method of using one potential embodiment of a toilet gag gift device of the present invention in accordance with the disclosed architecture.

The present invention is also comprised of a method of using 200 the device 100, as seen in FIG. 4. First, a device 100 is provided comprised of a body 110 having a receiving area 112 and at least one leg 120 [Step 202]. Then, the device 100 can be placed within a toilet bowl 10 as a humorous joke intended to play on scrotal ptosis [Step 204].

Figure 5:
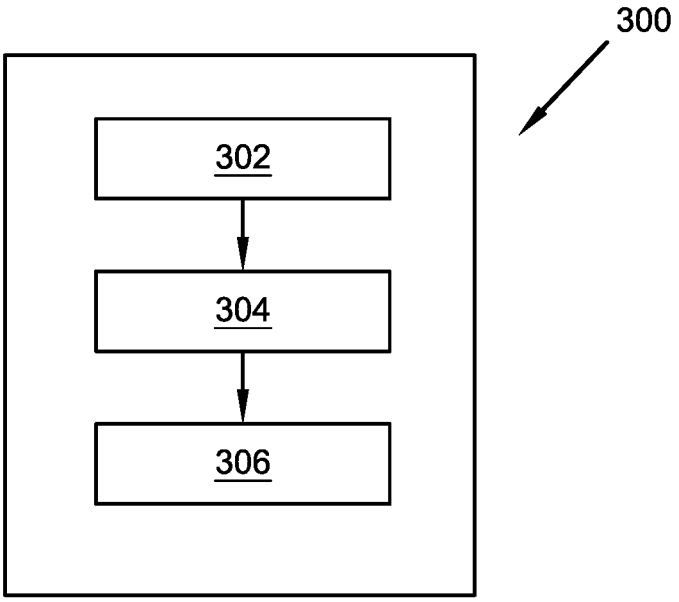
FIG. 5 illustrates a flowchart of a method of using one potential embodiment of a toilet gag gift device of the present invention in accordance with the disclosed architecture.

The present invention is also comprised of another method of using 300 the device 100, as seen in FIG. 5. First, a device 100 is provided comprised of a speaker 130, a sensor 134, and a body 110 having a receiving area 112 and at least one leg 120 comprised of at least one fastener 122 [Step 302]. Then, the device 100 can be placed within a toilet bowl 10 as a humorous joke intended to play on scrotal ptosis, wherein the leg 120 is secured to the toilet bowl 10 via the fastener 122 [Step 304]. Next, a user can approach and/or urinate into the toilet bowl 10 such that the sensor 134 detects motion of the user and causes the speaker 130 to activate to play a phrase, song, word, joke, etc., that may relate humorously to the condition of scrotal ptosis [Step 306].

Certain terms are used throughout the following description and claims to refer to particular features or components. As one skilled in the art will appreciate, different persons may refer to the same feature or component by different names. This document does not intend to distinguish between components or features that differ in name but not structure or function. As used herein "toilet gag gift device" and "device" are interchangeable and refer to the toilet gag gift device 100 of the present invention.

Notwithstanding the foregoing, the toilet gag gift device 100 of the present invention and its various components can be of any suitable size and configuration as is known in the art without affecting the overall concept of the invention, provided that they accomplish the above-stated objectives. One of ordinary skill in the art will appreciate that the size, configuration, and material of the toilet gag gift device 100 as shown in the FIGS. are for illustrative purposes only, and that many other sizes and shapes of the toilet gag gift device 100 are well within the scope of the present disclosure. Although the dimensions of the toilet gag gift device 100 are important design parameters for user convenience, the toilet gag gift device 100 may be of any size, shape, and/or configuration that ensures optimal performance during use and/or that suits the user's needs and/or preferences.

Various modifications and additions can be made to the exemplary embodiments discussed without departing from the scope of the present invention. While the embodiments described above refer to particular features, the scope of this invention also includes embodiments having different combinations of features and embodiments that do not include all the described features. Accordingly, the scope of the present invention is intended to embrace all such alternatives, modifications, and variations as fall within the scope of the claims, together with all equivalents thereof.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications, and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A toilet gag gift device comprising:
- a body comprised of a leg and a mesh basket receiving area; and
- wherein the receiving area comprises an image indicia relating humorously to the condition of scrotal ptosis; and
- further wherein the leg a bendable support leg configured to adjust a position of the body within a toilet bowl.

2. The toilet gag gift device of claim 1, wherein the body is scented.

3. A toilet gag gift device comprising:
- a body comprised of a receiving area;
- a leg comprised of a fastener;
- a speaker; and
- a sensor; and
- a rechargeable battery; and
- wherein the receiving area is a woven basket comprising a phrase indicia relating humorously to the condition of scrotal ptosis;
- wherein the leg a bendable support leg configured to adjust a position of the body within a toilet bowl; and
- further wherein the fastener is a magnetic fastener.

4. The toilet gag gift device of claim 3, wherein the body is scented.

5. The toilet gag gift device of claim 3, wherein the sensor is comprised of a motion sensor.

6. The toilet gag gift device of claim 5, wherein the activation of the sensor activates the speaker.

7. The toilet gag gift device of claim 6, wherein upon activation the speaker plays a phrase, a song, a word, or a joke that humorously relates to the condition of scrotal ptosis.

8. A method of using a toilet gag gift device, the method comprising the following steps:
- providing a toilet gag gift device comprised of a body having a receiving area and a leg; and
- placing the toilet gag gift device within a toilet bowl as a humorous joke; and
- wherein the receiving area is a mesh basket comprising an indicia relating humorously to the condition of scrotal ptosis;
- wherein the leg a bendable support leg configured to adjust a position of the body within a toilet bowl; and
- recharging a battery of the toilet gag gift device.

9. The method of using a toilet gag gift device of claim 8 further comprised of a step of attaching the leg to the toilet bowl via a fastener.

10. The method of using a toilet gag gift device of claim 9, wherein the fastener is comprised of a suction cup, an adhesive, or a magnet.

11. The method of using a toilet gag gift device of claim 8, wherein the toilet gag gift device is comprised of a speaker and a motion sensor.

12. The method of using a toilet gag gift device of claim 11, wherein activation of the motion sensor activates the speaker to play a phrase, a song, a word, or a joke that humorously relates to the condition of scrotal ptosis.

* * * * *